US005098556A

United States Patent [19]

Go et al.

[11] Patent Number: 5,098,556

[45] Date of Patent: Mar. 24, 1992

[54] TREATMENT OF OFF-SPECIFICATION WHITE MINERAL OIL MADE BY TWO STAGE HYDROGENATION

[75] Inventors: Caridad Go, Houston; Thomas F. Wulfers, Seabrook; Martin P. Grosboll, Kingwood; Frank F. McKay, Highlands, all of Tex.

[73] Assignee: Lyondell Petrochemical Company, Houston, Tex.

[21] Appl. No.: 537,570

[22] Filed: Jun. 14, 1990

[51] Int. Cl.[5] ..... C10G 25/00

[52] U.S. Cl. ..... 208/299; 208/245; 208/251 R; 208/254 R; 208/301; 208/307; 208/310 R

[58] Field of Search ..... 208/299, 301, 307, 245, 208/251 R, 254 R, 255, 310 R

[56] References Cited

U.S. PATENT DOCUMENTS

| | | | |
|---|---|---|---|
| 1,636,938 | 7/1927 | Kauffman et al. | 208/307 |
| 1,866,590 | 7/1932 | Baylis | 208/307 |
| 2,273,147 | 2/1942 | Schumaker et al. | 208/301 |
| 2,273,846 | 2/1942 | Dunmire | 208/299 |
| 2,666,732 | 1/1954 | McConnell | 208/299 |
| 2,666,733 | 1/1954 | Scovill | 208/299 |
| 2,795,535 | 6/1957 | Crosby et al. | 208/307 |
| 3,328,293 | 6/1967 | Brenken | 208/307 |
| 4,092,240 | 5/1978 | Mead et al. | 208/301 |
| 4,447,315 | 5/1984 | Lamb et al. | 208/310 Z |
| 4,810,355 | 3/1989 | Hopkins | 208/57 X |
| 4,812,436 | 3/1989 | Staal et al. | 208/307 X |
| 4,954,242 | 9/1990 | Gruta | 208/310 Z |

*Primary Examiner*—Theodore Morris
*Assistant Examiner*—William C. Diemler
*Attorney, Agent, or Firm*—Arnold, White & Durkee

[57] ABSTRACT

The invention relates to a method for removing RCS from off-spec white mineral oil prepared by catalytic hydrogenation by filtering the off-spec white mineral oil through a bleaching clay, such as a smectite clay, particularly an acid treated montmorillonite clay, such as bentonite or attapulgite.

20 Claims, No Drawings

TREATMENT OF OFF-SPECIFICATION WHITE MINERAL OIL MADE BY TWO STAGE HYDROGENATION

BACKGROUND OF THE INVENTION

This invention relates to a process for clay purification of white mineral oil which has been manufactured using a two-step catalytic hydrogenation process.

White mineral oil ("white oil") is used for a number of purposes. For example, white oil may be used as a plasticizer or as an extender for polymers, as an adhesive for food packaging, or as a caulk or sealant. White oil also may be used as a component in cosmetics and toiletries, such as hand and body lotions, sun care products, lipstick, make-up, make-up remover, cold cream, hair care products, in super fatted soaps and in bath oils.

All of the uses of white oil identified thus far use the oil outside of the human body. Even so, the FDA and white oil manufacturers have rigorous standards that these oils must meet in order to be marketable. The most rigorous standards, however, must be met by white oils which are for internal use in food and pharmaceutical applications, for example, as a laxative or as a binder in pills or tablets, or as an aid in raw food processing.

In all of these applications, white oil manufacturers must remove "readily carbonizable substances" ("RCS") from the white oil. RCS are impurities which cause the white oil to change color when treated with strong acid. The FDA, and white oil manufacturers, have stringent standards with respect to RCS which must be met before the white oil can be marketed for use in food or pharmaceutical applications. In particular, 21 C.F.R. §172.878 (1988) defines white mineral oil as a mixture of liquid hydrocarbons, essentially paraffinic and naphthenic in nature obtained from petroleum and refined to meet the test requirements of *United States Pharmacopoeia* XX, pp. 532 (1980) for readily carbonizable substances, and for sulfur compounds.

White mineral oil is prepared from a distillate of petroleum crude oil which has lubricating viscosity and may have been solvent refined and dewaxed or hydrotreated. In the past, various methods have been used to produce white mineral oil from crude oil. The traditional method has been treatment of the distillate with acid. After acid treatment, the white oil was often purified by clay treatment, called contact finishing, to remove by-products that have been created by the acid treatment.

Because it is a problem to dispose of the strong acid waste which results from acid treatment of the distillate, white oil manufacturers have developed new, cleaner methods of white mineral oil production. Applicants' preferred method is disclosed in U.S. Pat. No. 3,459,656, incorporated herein by reference. The process described in U.S. Pat. No. 3,459,656 is a two-step catalytic hydrogenation process. The catalyst used in the first step is a sulfur resistant, non-precious metal hydrogenation catalyst, such as tin, vanadium, chromium, molybdenum, tungsten, iron, cobalt, nickel, and mixtures thereof, present in catalytically effective amounts, for instance, about 2 to 30 weight percent. This first catalyst can be in the free metal or in the combined form, as an oxide or sulfide. The second catalyst comprises a platinum group metal-promoted catalyst, such as platinum, palladium, rhodium, or iridium, present in catalytically effective amounts, generally in the range of about 0.01–2 weight percent, preferably 0.1 to 1 weight percent. The platinum group metal can be present in the metallic form or as a sulfide, oxide or other combined form.

Unlike white oils created by acid treatment, this two-step catalytic hydrogenation process normally produces white oils which do not need further treatment in order to meet the stringent FDA and internal manufacturing specifications required of such oils. Occasionally, however, a batch of white oil is produced which appears to degrade rapidly, resulting in an unacceptable RCS content. The content of the RCS found in this "off-spec" white oil manufactured using catalytic hydrogenation was not clear; however, it was clear that the content was different than that associated with white oil manufactured using acid treatment.

Previously, manufacturers would try to salvage this high RCS oil by re-treating the oil using the two step catalytic hydrogenation process. Or manufacturers sold the oil to customers under a less stringent specification. Either route was costly and/or time consuming.

SUMMARY OF THE INVENTION

The present invention addresses the above problems by providing an inexpensive and effective method for salvaging off-spec white oils produced by catalytic hydrogenation.

It has been discovered that the RCS present in off-spec white oil produced by catalytic hydrogenation can be removed by contacting the off-spec oil with a bleaching clay, such as a smectite clay, particularly an acid treated montmorillonite clay, such as bentonite or attapulgite.

DETAILED DESCRIPTION OF THE INVENTION

White oil produced using a two step catalytic hydrogenation process such as described in U.S. Pat. No. 3,459,656, incorporated herein by reference, is collected and tested for RCS in accordance with ASTM D565-88 "Standard Test Method for Carbonizable Substances in White Mineral Oil". White oil is tested for the presence of RCS by treating the white oil with acid, repetitively mixing and heating the white oil/acid mixture, and comparing the color of the resulting mixture to a series of standards. The results of the test are expressed numerically as an "RCS" number, wherein the ASTM RCS reference standard colorimetric solution is assigned the number 3.0.

A white oil having a CS of approximately 2.5–3.5 is considered off specification, but treatable by clay purification. A white oil with an RCS of 4 or over generally has been found to be untreatable. After clay treatment, the white oil should have an RCS of under 2.5. The lower the RCS, the more purified the white oil.

EXAMPLE 1

Off specification white oil having an RCS of approximately 3.0 was passed through a column containing 5 g of the following virgin clays obtained from Englehard Corporation, 30100 Chagrin Blvd., Cleveland, Ohio, 44124. One hundred milliliter portions were collected and the third 100 ml portion yielded the following results:

| NAME | DESCRIPTION | APPEARANCE | OIL FLOW | RCS AFTER CLAY* |
|---|---|---|---|---|
| FCC Catalyst | Engelhard - Aluminosilicate Kaolin Clay | White Fine | Slow | 1.5 |
| Floridin | Fuller's Earth Attapulgite | Brown Mixed | Med | 1.0 |
| Filtrol 24 | Harshaw/Filtrol Bentonite Acid-leached granules | White Mixed | Med | 1.5 |
| Filtrol 25 | Harshaw/Filtrol Bentonite Acid-leached granules | White Coarse | Fast | 1.5 |
| Filtrol 62 | Harshaw/Filtrol Bentonite Acid-leached granules | Light Brown Extruded | Fast | 1.5 |

*3 × 100 mls of AP70 (CS = 3.0) passed thru a column containing 5 g of virgin clay. RCS test results obtained from the 3rd 100 ml portion.

Although the RCS of white oil treated with Floridin was the lowest, 1.0, Floridin is not an acid treated clay. Acid treated clays generally are believed to remove carbonizables more efficiently than non-acid treated clays. Thus, for example, a single run of off-spec white oil through an acid treated clay might be sufficient to remove RCS, where it could take more than one run through a clay that has not been acid treated.

In addition, of the clays tested, Filtrol 24 proved to have the best mesh for packing the clay, whereas Filtrol 25 and Filtrol 62 did not pack as well. Therefore, applicant's currently preferred clay is Filtrol 24; however, one of skill in the art will recognize that the particle size of a particular clay can be varied.

All of the listed clays except for FCC Catalyst must be disposed of after use, e.g. in a landfill. FCC Catalyst does not have this disposal requirement because, after use in the invention, FCC Catalyst can be used in other petroleum refining processes. Thus, FCC Catalyst would be an ideal clay for use in the invention, except that FCC Catalyst is a very fine clay which retards passage of the white oil. Thus, a simple gravity driven flow procedure would be impractical for use with FCC Catalyst. A pump or ebullient bed would be required to force the white oil through the FCC catalyst.

While the invention has been described with respect to various specific examples and embodiments, it is to be understood that the invention is not limited thereto. Many variations and modifications may be made upon the specific examples disclosed herein, and the appended claims are intended to cover all of these variations and modifications.

What is claimed is:

1. A process for removing RCS from white mineral oil prepared by catalytic hydrogenation and having an RCS value ranging from about 2.5 to about 3.5 consisting essentially of the step of filtering said white mineral oil through a filter bed consisting essentially of a bleaching clay for a period of time sufficient to remove said RCS from said white oil to produce a purified white oil having a RCS value of 2.5 or less, and collecting said purified white oil.

2. The process of claim 1 wherein said clay is an acid treated clay.

3. The process of claim 1 wherein said clay is a smectite clay.

4. The process of claim 2 wherein said clay is a smectite clay.

5. The process of claim 1 wherein said clay is a montmorillonite clay.

6. The process of claim 2 wherein said clay is a montmorillonite clay.

7. The process of claim 1 wherein said clay is a bentonite clay.

8. The process of claim 2 wherein said clay is a bentonite clay.

9. The process of claim 1 wherein said clay is FCC Catalyst.

10. The process of claim 2 wherein said clay is FCC Catalyst.

11. The process of claim 9 wherein said white oil is forced through said FCC Catalyst using a pump.

12. The process of claim 10 wherein said white oil is forced through said FCC Catalyst using a pump.

13. The process of claim 9 wherein said white oil is forced through said FCC Catalyst using an ebullient bed.

14. The process of claim 10 wherein said white oil is forced through said FCC Catalyst using an ebullient bed.

15. The process of claim 1 wherein the day is kaolin.

16. The process of claim 2 wherein the clay is kaolin.

17. The process of claim 1 wherein the clay is attapulgite.

18. The process of claim 2 wherein the clay is attapulgite.

19. The process of claim 1 wherein the clay is fuller's earth attapulgite.

20. The process of claim 2 wherein the clay is fuller's earth attapulgite.

* * * * *